US007597474B2

(12) United States Patent
Baumann

(10) Patent No.: US 7,597,474 B2
(45) Date of Patent: Oct. 6, 2009

(54) APPARATUS FOR SHIELDING X-RAYS AND X-RAY DEVICE INCORPORATING SAID APPARATUS

(75) Inventor: Thomas Baumann, Munster (DE)

(73) Assignee: Unisantis FZE, Dubai (AE)

( * ) Notice: Subject to any disclaimer, the term of this patent is extended or adjusted under 35 U.S.C. 154(b) by 0 days.

(21) Appl. No.: 12/064,386

(22) PCT Filed: Aug. 17, 2006

(86) PCT No.: PCT/EP2006/008143

§ 371 (c)(1),
(2), (4) Date: Sep. 24, 2008

(87) PCT Pub. No.: WO2007/022918

PCT Pub. Date: Mar. 1, 2007

(65) Prior Publication Data

US 2009/0074147 A1 Mar. 19, 2009

(30) Foreign Application Priority Data

Aug. 22, 2005 (EP) ..... 05018170

(51) Int. Cl.
*G21K 1/02* (2006.01)

(52) U.S. Cl. ..... 378/203; 378/145

(58) Field of Classification Search ..... 378/70, 378/84, 85, 145, 203

See application file for complete search history.

(56) References Cited

U.S. PATENT DOCUMENTS 3,849,649 A 11/1974 Carey
4,221,971 A 9/1980 Burger
4,940,319 A * 7/1990 Ueda et al. ..... 378/84
5,937,026 A 8/1999 Satoh
6,477,237 B1 * 11/2002 Taniguchi et al. ..... 378/145
6,577,705 B1 6/2003 Chang et al.
7,231,015 B2 * 6/2007 Kumakhov ..... 378/147
7,468,516 B2 * 12/2008 Smither ..... 378/85
2008/0317211 A1 * 12/2008 Baumann ..... 378/145

FOREIGN PATENT DOCUMENTS

DE 33 23 477 A1 1/1984

OTHER PUBLICATIONS

International Search Report of PCT/EP2006/008143, date of mailing Oct. 30, 2006.

* cited by examiner

*Primary Examiner*—Chih-Cheng G Kao
(74) *Attorney, Agent, or Firm*—Westerman, Hattori, Daniels & Adrian, LLP

(57) ABSTRACT

An X-ray shielding apparatus (40) and an X-ray device incorporating such an apparatus are described. The apparatus (40) comprises a stationary member (94) having an aperture and one or more shielding members (96, 98) movable in relation to the stationary member (94) and made from an X-ray shielding material. The one or more shielding members (96, 98) define an X-ray passage (90) within the aperture that is smaller than the aperture. Movement of the one or more shielding members (96, 98) is restricted such that the one or more shielding members (96, 98) in each position relative to the stationary member (94) cover the aperture at least in an area outside the X-ray passage (90).

15 Claims, 6 Drawing Sheets

APPARATUS FOR SHIELDING X-RAYS AND X-RAY DEVICE INCORPORATING SAID APPARATUS

FIELD OF THE INVENTION

The present invention relates to an apparatus for shielding X-rays. The invention further relates to an X-ray device such as an X-ray spectrometer or an X-ray diffractometer comprising an X-ray shielding apparatus.

BACKGROUND OF THE INVENTION

The advent of so-called X-ray lenses (also called "Kurnakhov lenses") over two decades ago has prepared the ground for lightweight, portable X-ray devices with a broad spectrum of applications in areas as different as metallurgy, geology, chemistry, forensic laboratories and customs inspection. In a similar way as conventional optical lenses redirect visible or near-visible photons, X-ray lenses redirect electromagnetic radiation in the X-ray radiation band and may thus be used to collimate or focus a beam of X-rays.

An X-ray lens is conventionally formed from a plurality of capillaries. Each capillary guides the X-rays captured at a front end thereof to the opposite end by way of total external reflection. This rule applies so long as the angle of incidence at the front end does not exceed a critical angle. If the critical angle is exceeded, X-rays can no longer be captured within the capillary. In such a case, the capillary becomes transparent to the X-rays.

Originally, an X-ray lens was a bulky device with dimensions in the region of up to several meters. These large dimensions were mainly the result of separate support structures that were required to keep the individual capillaries in place. Commercial use of X-ray lenses became feasible when it was recognized that the support structures can be omitted if the X-ray lens is produced out of one or more glass capillary bundles using glass drawing techniques. By fusing the capillary mantles together, separate support structures became obsolete.

Today, the commercial application of X-ray lenses includes portable X-ray spectrometers, lightweight X-ray diffractometers and many other small-sized devices. Such devices typically comprise an X-ray source (such as an X-ray tube), an X-ray lens and a detector. X-rays emitted from the X-ray source are focused by the X-ray lens onto a tiny spot on a sample. The detector detects the X-rays emitted back from the sample and generates an output signal that can for example be spectrally analysed to determine the chemical elements included in the sample.

As is well known, the exposition to X-rays is hazardous to human beings such as operators of X-ray spectrometers X-ray diffractometers and other X-ray devices. Accordingly, the construction of such devices necessitates X-ray safety considerations.

There are various approaches to cope with the hazards resulting from X-ray radiation in X-ray devices. One approach is the incorporation of shielding materials. If the X-ray devices include only stationary components, shielding can quite easily be effected by means of stationary shielding walls. In devices with movable components such as a positioning mechanism for an X-ray lens, however, it is often necessary to provide a more sophisticated shielding mechanism that includes an adjustable X-ray passage.

Accordingly, there is a need for an X-ray shielding apparatus having an adjustable X-ray passage. Also, there is a need for an X-ray device including an X-ray shielding apparatus with an adjustable X-ray passage.

SUMMARY OF THE INVENTION

According to a first aspect of the invention, an X-ray shielding apparatus having an adjustable X-ray passage is provided. The X-ray shielding apparatus comprises a stationary member having an aperture and one or more shielding members that are movable in relation to the stationary member and made from an X-ray shielding material. The one or more shielding members define an X-ray passage within the aperture that is smaller than the aperture, and the movement of the one or more shielding members is restricted such that the one or more shielding members in each position relative to the stationary member cover the aperture at least in an area outside the X-ray passage.

The X-ray passage may for example be defined by an opening of a single shielding member or by the intersection of openings of several shielding members. In one variation, the one or more shielding members completely cover the aperture in an area outside the X-ray passage. Depending on the shielding requirements, it may in another variation be sufficient to cover the aperture not completely, but at least in a portion surrounding the X-ray passage.

A guiding mechanism for guiding the movement of the at least one shielding member in relation to the stationary member may be provided. The guiding mechanism may include a guided element coupled to one of the stationary member and the least one shielding member. The guided element may be constituted by a protrusion coupled to the at least one shielding member. Additionally, the guiding mechanism may include a guiding structure coupled to the other one of the stationary member and the at least one shielding member and defining a stop for the guided element. The guiding structure is for example constituted by a rim of the stationary member or of the at least one shielding member. In one embodiment, the guiding structure is constituted by a rim of the aperture of the stationary member.

The one or more shielding members may have various shapes. Preferably, the shielding members have a substantially planar shape (such as a disc or washer). In one example, the at least one shielding member is constituted by an annular ring plate.

As mentioned above, the X-ray shielding apparatus may either comprise a single shielding member or a plurality of individual shielding members. If two or more shielding members are provided, the individual shielding members may be arranged one behind the other and may collectively cover the aperture except for the area of the X-ray passage. In one implementation, the X-ray shielding apparatus comprises a first shielding member with a first opening and a second shielding member with a second opening. The second opening may have a smaller size than the first opening and may thus substantially define the X-ray passage. Moreover, the first shielding member may have a first outer diameter and the second shielding member may have a second outer diameter substantially smaller than the first outer diameter.

The X-ray shielding apparatus may include a tube member extending through the first and the second (and any further) shielding members. In one embodiment, the tube member has a diameter that essentially corresponds to the diameter of the smallest one of the first and the second (and any further) openings. Preferably, the tube member is constituted by an X-ray lens or is configured to receive an X-ray lens. The axial position of the tube member relative to one or both of the first and second shielding members may be adjustable (e.g. for positioning an inlet focus or an outlet focus of the X-ray lens).

According to a further aspect of the invention, an X-ray device is provided. The X-ray device comprises an X-ray source, an X-ray lens for redirecting X-rays emitted from the X-ray source, and an X-ray shielding component for selectively transmitting X-rays towards or through the X-ray lens. The X-ray shielding component includes a stationary member having an aperture and one or more shielding members movable in relation to the stationary member and made from an X-ray shielding material, wherein the one or more shielding members define an X-ray passage within the aperture that is smaller than the aperture and wherein the movement of the one or more shielding members is restricted such that the one or more shielding members in each position relative to the stationary member cover the aperture at least in an area outside the X-ray passage.

The X-ray lens may comprise one or more bundles of capillaries. Furthermore, the X-ray device may comprise a positioning component for the X-ray lens that is disposed downstream of the shielding component and that is made from a material (such as a aluminium) essentially transparent to X-rays.

BRIEF DESCRIPTION OF THE DRAWINGS

Further aspects, advantages and variations of the invention will become apparent from the following description of a preferred embodiment and from the drawings.

DESCRIPTION OF A PREFERRED EMBODIMENT

In the following, the invention will exemplarily be described with reference to a preferred embodiment in the form of an X-ray spectrometer comprising an X-ray shielding apparatus with one stationary member and two movable shielding members. It should be noted that the invention can also be practised in other X-ray devices such as diffractometers and in shielding apparatuses having a different structure (e.g. including more than one stationary member and/or including one, three or more shielding members). Also, while the invention is hereinafter described with reference to shielding members having central circular openings, the X-passage may alternatively be defined by shielding members having eccentric openings or having any other kind of means for defining the X-ray passage.

Figure 1:
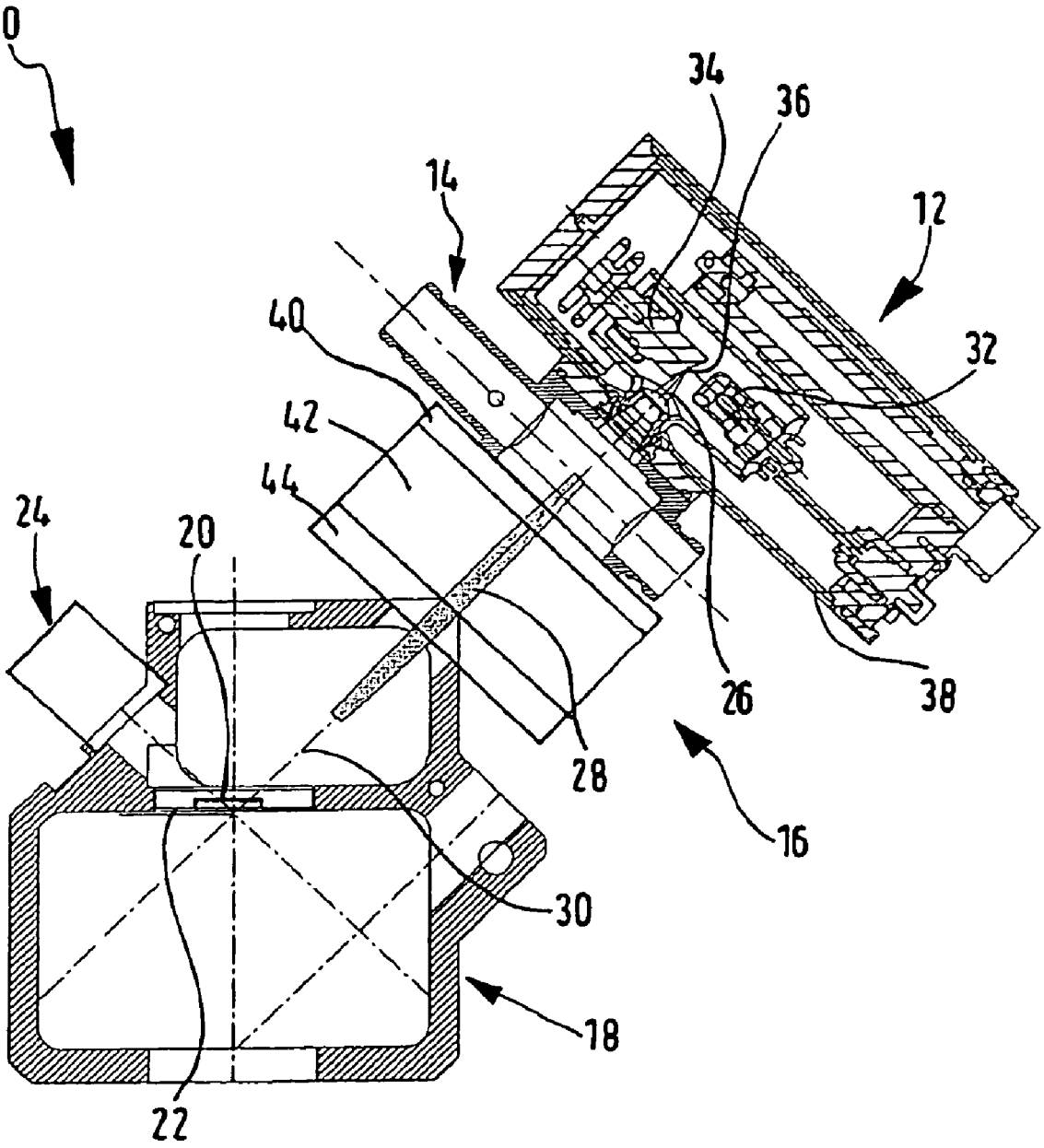
FIG. 1 shows a cross sectional view of an X-ray spectrometer embodiment of the present invention.

FIG. 1 shows a cross sectional view of an X-ray spectrometer 10 according to an embodiment of the present invention. The spectrometer 10 includes an X-ray source 12 constituted by an X-ray tube. The spectrometer 10 further comprises a shutter 14, a positioning/shielding module 16, a sample housing 18 with a sample 20 arranged on a sample positioning platform 22, and a detector 24.

An X-ray beam generated within the X-ray source 12 and indicated by reference numeral 26 passes along an optical axis 30 through the shutter 14. An X-ray (or Kumakhov) lens 28 focuses the X-ray beam onto a tiny spot on the sample 20 (note that the size of the sample 20 is exaggerated in the schematic drawing of FIG. 1). The detector 24 collects the X-rays emitted back from the sample 20 and outputs a spectrum signal indicative of the chemical elements included in the sample 20. In the view of FIG. 1, the X-ray source 12 and the shutter 14 have been rotated by 90° about the optical axis 30 of the spectrometer 10 to better illustrate their structure.

The spectrometer 10 shown in FIG. 1 has a compact tabletop design and is transportable for in-situ analysis. The samples may be provided in a wide range of physical forms, including solids, powders, pressed pellets, liquids, granules, films and coatings. The typical element detection capabilities of the spectrometer 10 under atmospheric conditions range from aluminum (Al) to uranium (U). The spectrometer 10 allows for a qualitative and quantitative elemental analysis down to very low elemental concentrations and sample sizes of 20 μm.

Like conventional X-ray tubes, the X-ray source 12 includes a cathode 32 to emit electrons and an anode 34 to collect the electrons emitted by the cathode 32. Thus, a flow of electrical current is established as the result of a high voltage connected across the cathode 32 and the anode 34. The electron flow within the X-ray source 12 is focussed onto a very small spot (the "hot spot") 36 on the anode 34. The anode 34 is precisely angled at typically 5 to 15 degrees off perpendicular to the electron current so as to allow the escape of some of the X-rays generated at the "hot spot" 36 upon annihilation of the kinetic energy of the electrons colliding with the anode 34. The X-ray beam 26 thus generated is emitted from the "hot spot" 36 essentially perpendicular to the direction of the electron current and essentially along the optical axis 30 at diverging angles.

The X-rays emitted from the X-ray source 12 first pass the shutter 14 attached to a housing 38 of the X-ray source 12. The shutter 14 selectively blocks the X-ray beam 26 generated within the X-ray source 12 and thus provides a control mechanism for selectively switching the Irradiation of the sample 20 "on" or "off".

The positioning/shielding module 16 is arranged downstream (in relation to X-ray source 12) of the shutter 14 and is rigidly attached to the shutter 14 by means of an interface member (not shown in FIG. 1). The positioning/shielding module 16 includes an X-ray shielding component 40, a positioning component 42 for the X-ray lens 28, and a lens mounting component 44 for rigidly coupling the X-ray lens 28 to the positioning component 42. The individual components 40, 42, 44, which are shown only schematically in FIG. 1, are illustrated in more detail in the various views of FIGS. 2 to 6.

As becomes apparent from FIGS. 3 to 6, the X-ray shielding component 40 has an outer flange 46 with two screw holes 48 for rigidly attaching the entire positioning apparatus 16 to the shutter 14 (and thus to the X-ray source 12). The outer flange 46 therefore serves as an interface member of the positioning/shielding module 16 in relation to the shutter 14/the X-ray source 12. The X-ray shielding component 40 further comprises structural elements for limiting the X-ray beam essentially to an inlet opening of the X-ray lens 28. These structural elements will be described in more detail below.

The X-ray lens (not shown in FIGS. 2 to 6) is fixedly mounted in a tube member 50. The tube member 50 in turn is rigidly coupled to the lens mounting component 44. The lens mounting component 44 comprises a base member 52 attached to the positioning component 42. The base member 52 has a central opening for receiving the tube member 50. A plurality of tongues 54 with outer threaded portions 56 extend from the opening of the base member 52 and in the axial direction of the tube member 50.

The lens mounting component 44 further comprises a collar member 58 with a central opening through which the tube member 50 extends. The collar member 58 can be screwed onto the tongues 54 and cooperates with their outer threaded portions 56. Be means of an additional screw (not shown) extending in perpendicular to the tube member 50 and through the collar member 58, the free end of at least one of the tongues 54 can be moved towards the tubular member 50 as the screw is screwed into the collar member 58. Accordingly, a clamping connection between the tubular member 50 on the one hand and the lens mounting component 44 on the other hand is established.

The positioning component 42 is arranged upstream of the lens mounting component 44 and includes two translation stages 60, 62 as well as two goniometer stages 64, 66. As can be seen from FIG. 2, the base member 52 of the lens mounting means 44 is attached to the bottom of the first translation stage 60.

The individual positioning stages 60, 62, 64, 66 are arranged one behind the other. Starting with a first translation stage 60 as the most downstream positioning stage, a second translation stage 62, a first goniometer stage 64 and a second goniometer stage 66 as the most upstream positioning stage follow. Each of the positioning stages 60, 62, 64, 68 has a central X-ray passage 68, 70, 72, 74, respectively, through which the tubular member 50 extends.

In combination, the first translation stage 60 and the second translation stage 62 form an xy translation stage. Accordingly, the first translation stage 60 has a first axis of translation, namely the x axis, which in FIG. 2 runs perpendicular to the axis of the tubular member 50 and in parallel to the drawing plane. The second translation stage 62 has a second axis of translation, namely the y axis which runs perpendicular to the x axis and perpendicular to the axis of the tubular member 50. By means of respective knobs, the first and second translation stage 60, 62 can be actuated independently from each other. In an alternative embodiment not shown in the drawings, a third translation stage having a third axis of translation (z axis) that runs perpendicular to both the first and second axis of translation may be provided.

The two goniometer stages 64, 66 are arranged upstream of the two translation stages 60, 62. In their combination, the first goniometer stage 64 and the second goniometer stage 66 form a theta-phi goniometer that provides for two independent rotations about a common centre of rotation. This common centre of rotation is substantially constituted by the "hot spot" 36 shown in FIG. 1, i.e. by the X-ray emitting portion of the X-ray source 12.

An actuation of the first goniometer stage 64 tilts the tube member 50 (with the X-ray lens) about a first tilting axis that runs through the "hot spot" 36 shown in FIG. 1 and in the drawing plane of FIG. 1 perpendicular to the optical axis 30. An actuation of the second goniometer stage 66 tilts the tube member 50 about a second tilting axis that also runs through the "hot spot" 36 and that is perpendicular to both the first tilting axis and the drawing plane of FIG. 1.

Figure 4:
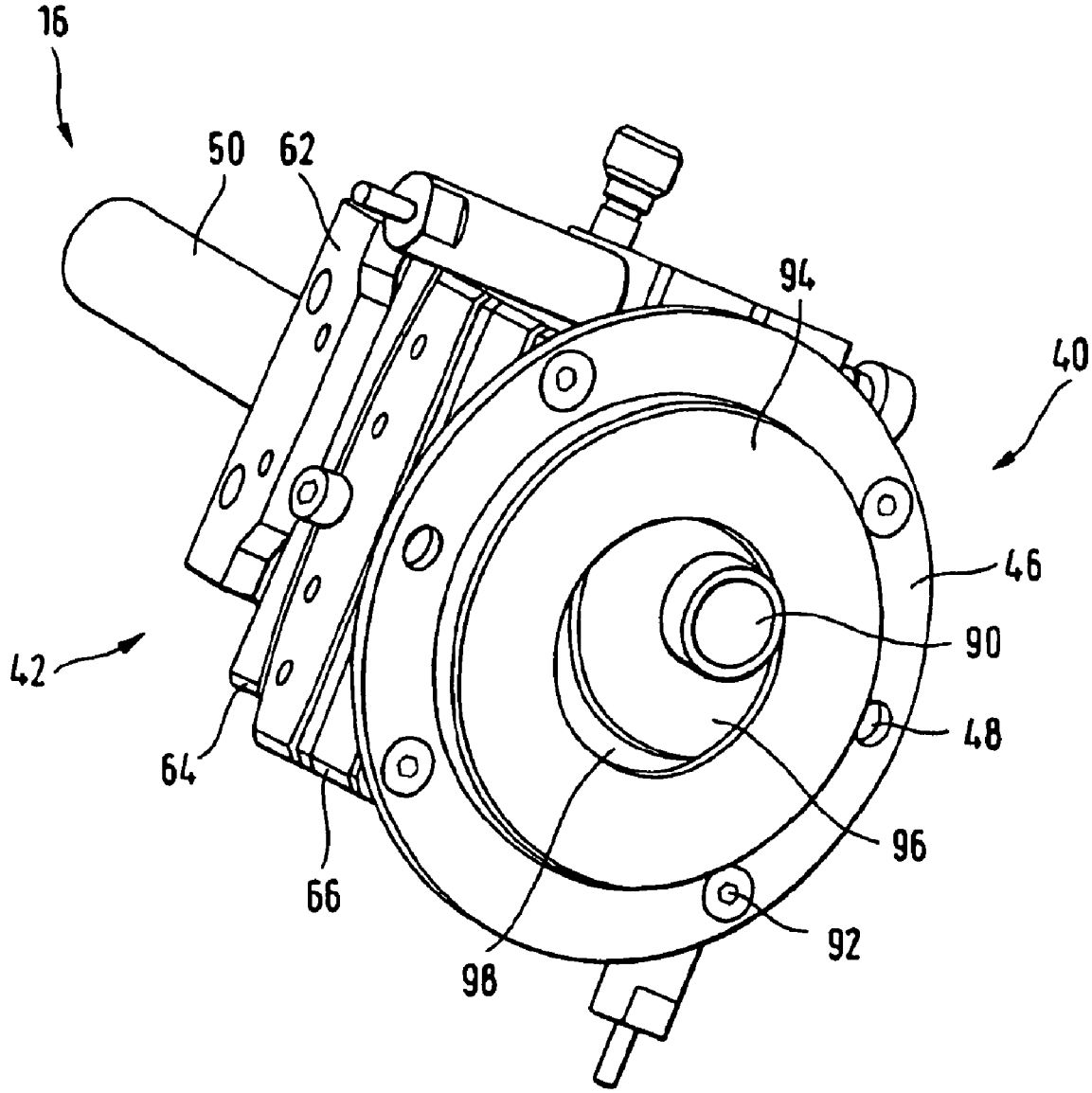
FIG. 4 shows a perspective view of the upstream end of the apparatuses of FIG. 2.

The X-ray shielding component 40 is attached to the upstream end of the second translation stage 66 via screws extending through openings 92 in the flange portion 46 (FIG. 4). The shielding component 40 is configured to block all X-rays outside the circular X-ray passage defined by the upstream (Inlet) opening 90 of the tubular member 50 and thus efficiently shields the positioning component 42 from X-rays. Accordingly, the individual components of the positioning component 42 (such as the translation stages 60, 62 and the goniometer stages 64, 66) can without any X-ray safety problem be manufactured from conventional materials (such as aluminium) which generally are transparent or nearly transparent to X-rays.

Figure 5:
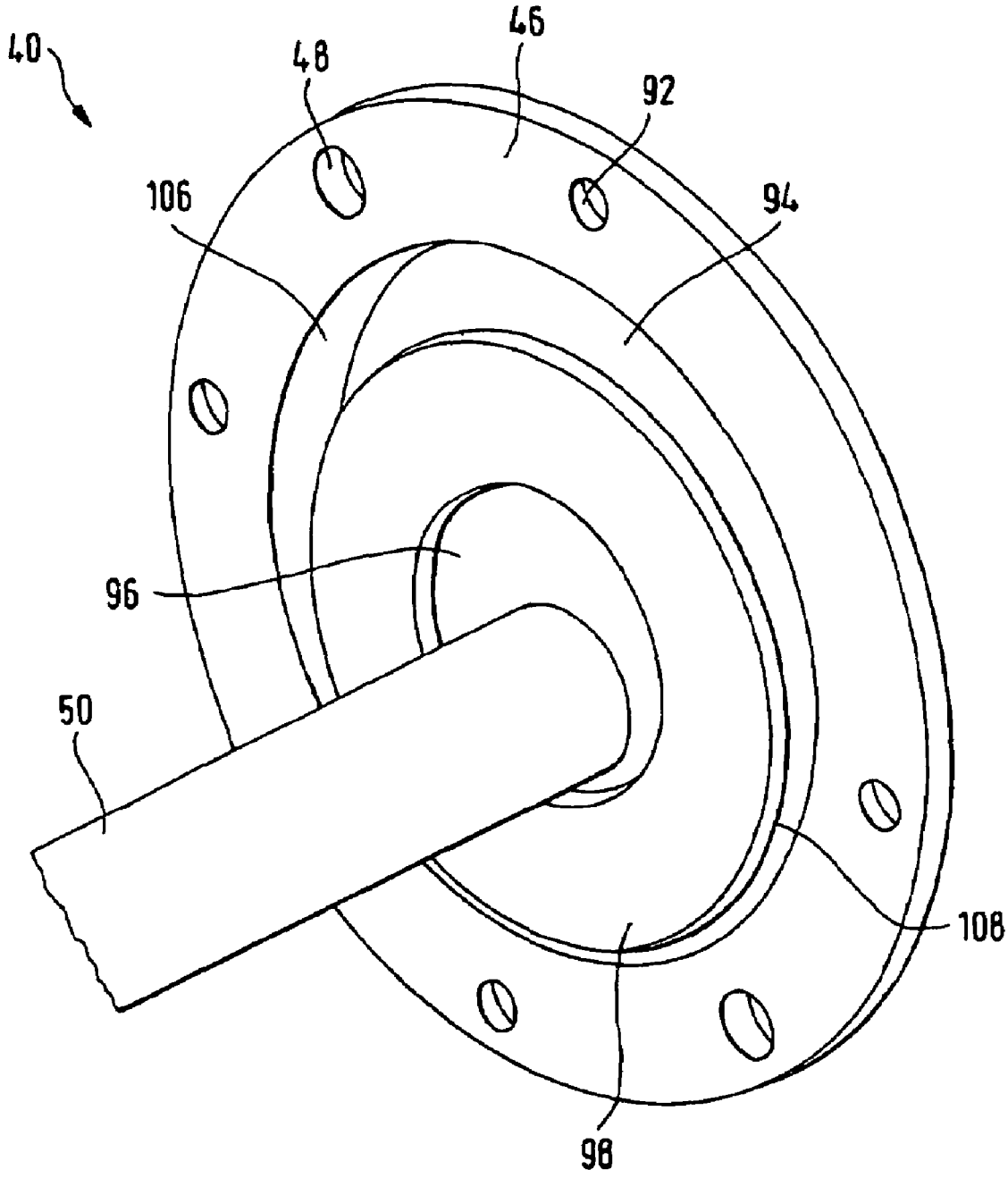
FIG. 5 shows a perspective view of the downstream end of the shielding apparatus of FIG. 2.
Figure 6:
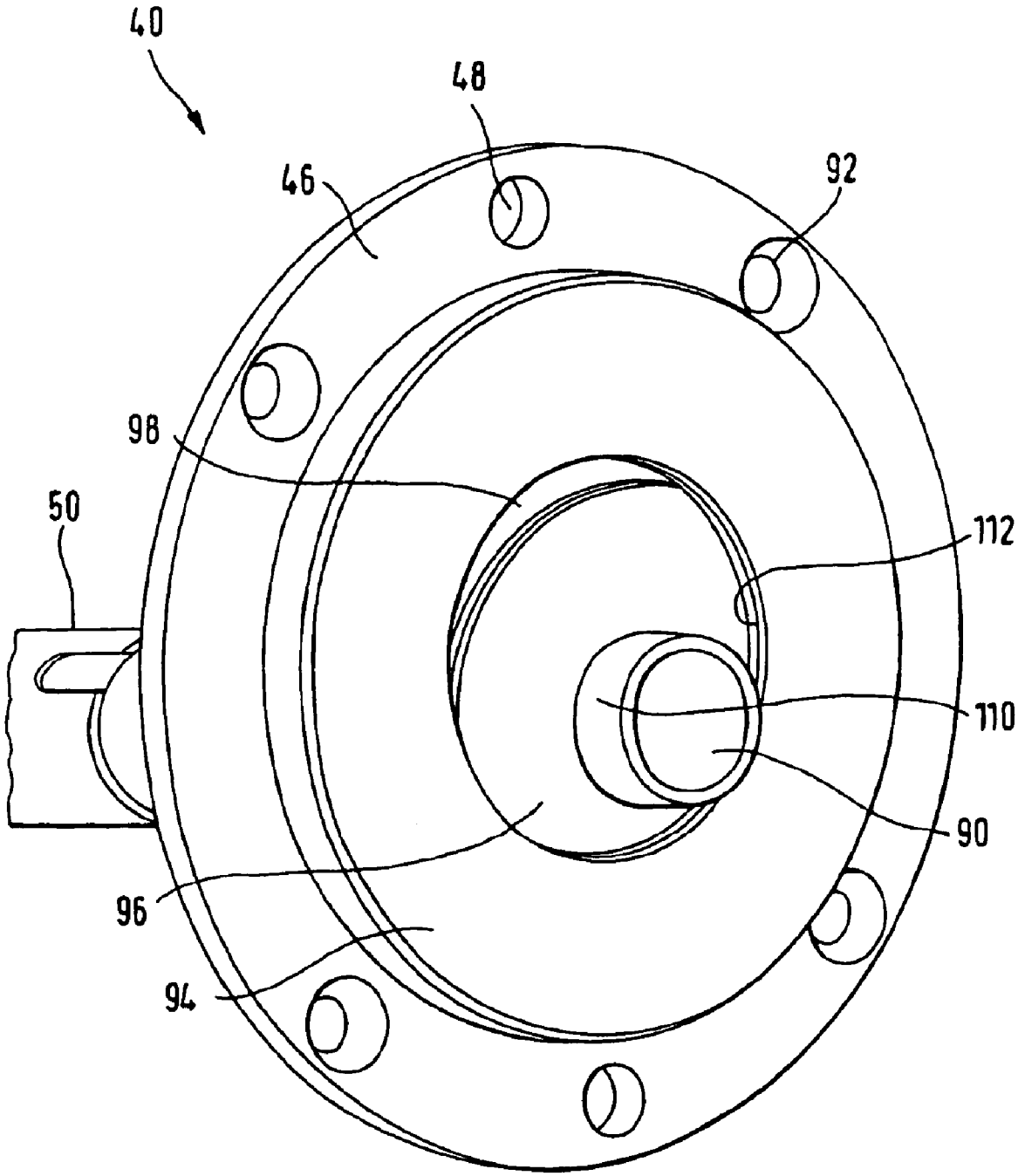
FIG. 6 shows a perspective view of the upstream end of the shielding apparatus of FIG. 2.

The construction of the X-ray shielding component 40 will now be described with particular reference to FIGS. 2, 5 and 6. In the embodiment, the X-ray shielding component 40 includes three separate members, namely a stationary member 94 and two movable shielding members 96, 98. The stationary member 94 and the shielding members 96, 98 are made from an X-ray shielding material such as steel.

Figure 2:
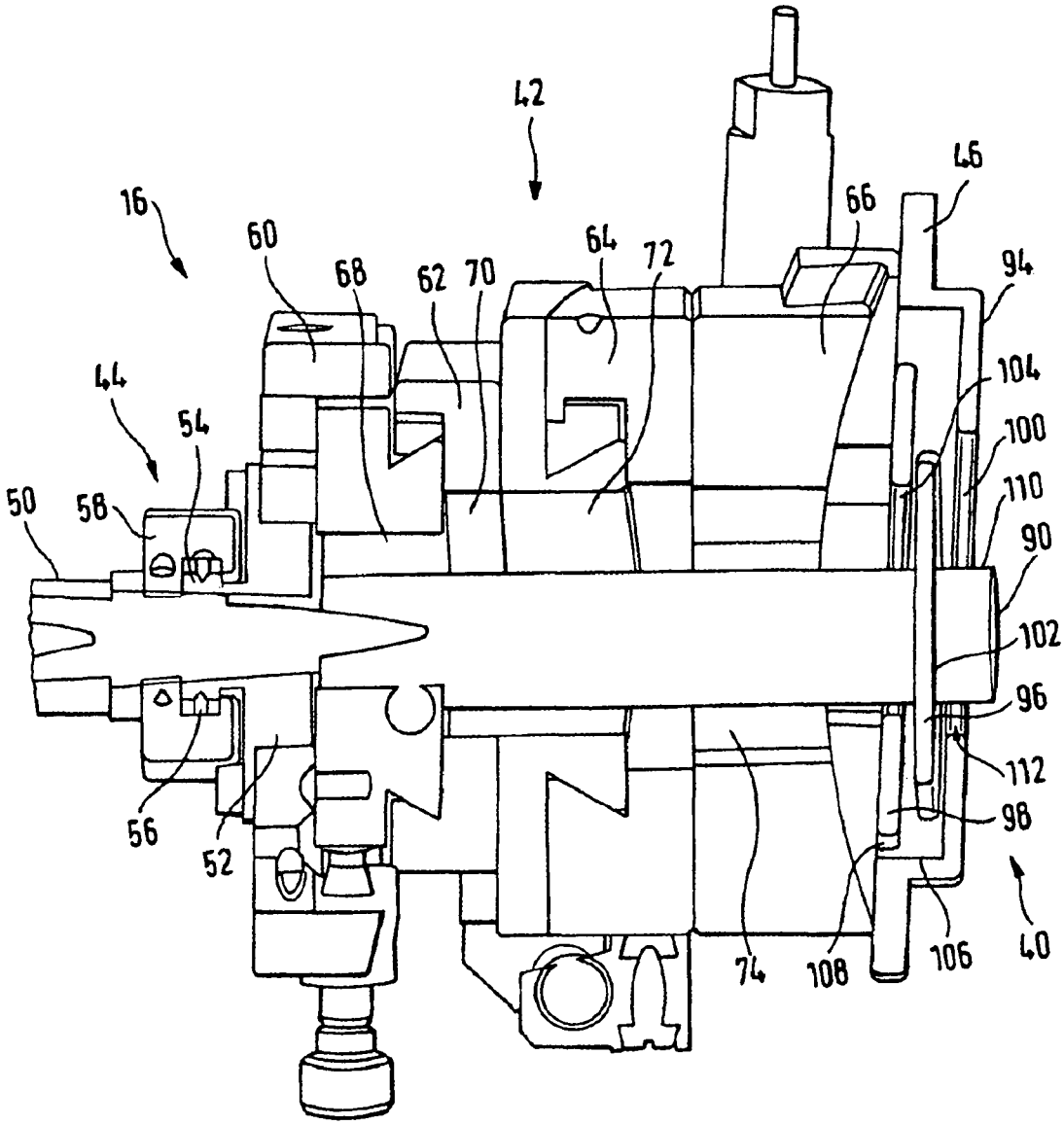
FIG. 2 shows a cross sectional view of a positioning apparatus and a shielding apparatus included in the X-ray spectrometer of FIG. 1.
Figure 3:
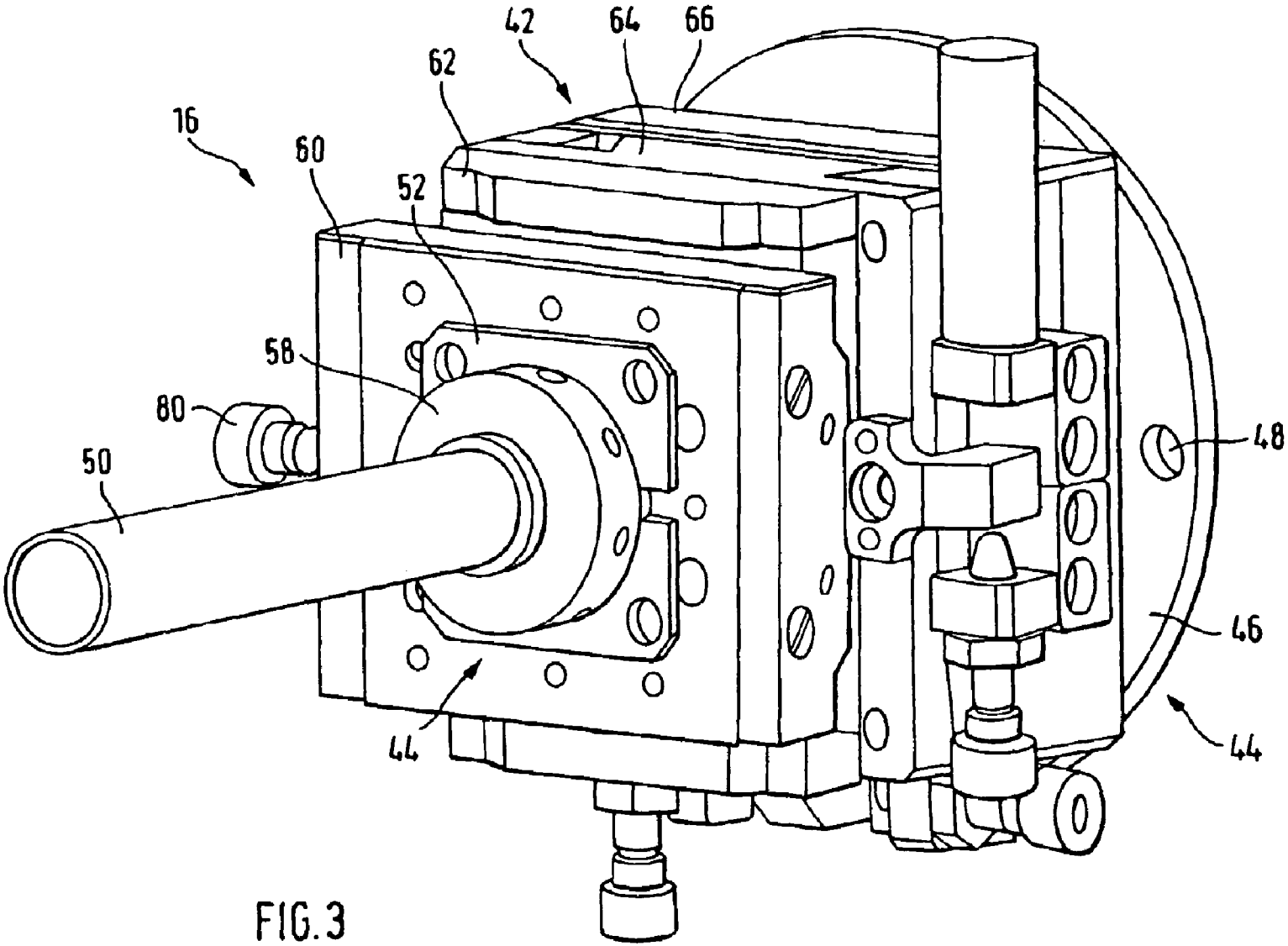
FIG. 3 shows a perspective view of the downstream end of the apparatuses of FIG. 2.

The stationary member 94 is integrally formed with the flange 46 and has a pot shape with a central circular aperture 100 in its bottom (FIG. 2). The stationary member 100 forms a housing for the two shielding members 96, 98. Each of the two shielding members 96, 98 is disc-shaped and has a central circular opening 102, 104.

The shielding members 96, 98 are arranged one behind the other within the housing defined by the stationary member 94. The outer diameter of the downstream shielding member 98 is larger than the outer diameter of the upstream shielding member 96. Moreover, the diameter of the opening 104 of the downstream shielding member 98 is larger than the diameter of the opening 102 of the upstream shielding member 96.

The tube member 50 extends trough the openings 102, 104 of the shielding members and through the aperture 100 of the stationary member 94. The diameter of the opening 102 of the upstream shielding member 96 essentially corresponds to the outer diameter of the tube member 50. The upstream shielding member 96 is mounted on the tube member 50 by means of a press fit connection. The press fit is not completely rigid, so that the axial position of the upstream shielding member 96 in relation to the tube member 50 can be adjusted. The diameter of the central opening 104 of the downstream shielding member 98 is substantially larger than the outer diameter of the tube member 50. Accordingly, the downstream shielding member 98 is only loosely coupled to the tube member 50 and is movable in a radial direction relative to the tube member 50.

The outer diameters of the shielding members 96; 98 as well as the diameters of the respective openings 102, 104 and of the aperture 100 of the stationary member 94 are chosen such that the shielding members 96, 98 may in each position relative to the stationary member 94 completely cover the aperture 100 in an area outside the X-ray passage defined by the inlet opening 90 of the tube member 50. This can be seen in FIGS. 4 and 6.

The movement of the shielding members 96, 98 in relation to the stationary member 94 is guided by a guiding mechanism that includes the inner rim 106 of the pot-shaped stationary member 94, the outer rim 108 of the downstream shielding member 98, the outer surface of the tube member 50, and the rim 112 of the aperture 100. The guiding mechanism ensures that none of the shielding members 96, 98 can be moved (by an actuation of the positioning component 42) to a position where the aperture 100 is not covered in an area surrounding the inlet opening 90 of the tube member 50. To this end, the outer rim 108 of the shielding member 98 cooperates with the inner rim 106 of the stationary member 94, and the outer surface of the tube member 50 annular cooperates with the inner rim 112 of the aperture 100.

Accordingly, the tube member 50 can arbitrarily be positioned (by means of the positioning component 42, which thus "actuates" the shielding member 40) without any X-ray safety problem resulting from X-rays passing through the aperture 100 outside the inlet opening 90. Moreover, the individual parts of the positioning component 42 can be manufactured without any X-ray safety problem from aluminium which is transparent to X-rays.

While the current invention has been described with respect to a particular embodiment, those skilled in the art will recognize that the current invention is not limited to the specific embodiment described and illustrated herein. Therefore, it is to be understood that the present disclosure is only illustrative. It is intended that the invention be limited only by scope of the claims appended hereto.

The invention claimed is:

1. An X-ray shielding apparatus having an adjustable X-ray passage, the X-ray shielding apparatus comprising:

a stationary member having an aperture;

one or more shielding members movable in relation to the stationary member and made from an X-ray shielding material, the one or more shielding members having openings defining an X-ray passage within the aperture that is smaller than the aperture, wherein the movement of the one or more shielding members is restricted such that the one or more shielding members in each position relative to the stationary member cover the aperture at least in an area outside the X-ray passage; and a tube member constituted by an X-ray lens or configured to receive an X-ray lens, wherein one of the one or more shielding members is mounted on the tube member such that the tube member extends through the opening of this shielding member and through the aperture of the stationary member.

2. The X-ray shielding apparatus of claim 1, further comprising a guiding mechanism for guiding the movement of the at least one shielding member in relation to the stationary member, the guiding mechanism including a guided element coupled to one of the stationary member and the at least one shielding member; and a guiding structure coupled to the other one of the stationary member and the at least one shielding member, the guiding structure defining a stop for the guided element.

3. The X-ray shielding apparatus of claim 2, wherein the guiding structure is constituted by a rim of the stationary member or of the at least one shielding member.

4. The X-ray shielding apparatus of claim 3, wherein the guiding structure is constituted by a rim of the aperture of the stationary member.

5. The X-ray shielding apparatus of claim 2, wherein the guided element is constituted by a protrusion coupled to the at least one shielding member.

6. The X-ray shielding apparatus of claim 1, wherein the at least one shielding member is disk-shaped.

7. The X-ray shielding apparatus of claim 1, wherein the at least one shielding member is constituted by an annular ring plate.

8. The X-ray shielding apparatus of claim 1, wherein the X-ray shielding apparatus comprises a first shielding member with a first opening and a second shielding member with a second opening, the second opening having a smaller size than the first opening and substantially defining the area of X-ray passage.

9. The X-ray shielding apparatus of claim 8, wherein the first shielding member has a first outer diameter and the second shielding member has a second outer diameter, the second outer diameter being smaller than the first outer diameter.

10. The X-ray shielding apparatus of claim 8, wherein the first and second shielding members are arranged one behind the other and collectively cover the aperture except for the area of the X-ray passage.

11. The X-ray shielding apparatus of claim 8, wherein the tube member extends through the first and second shielding members, and has a diameter that essentially corresponds to the diameter of the smaller one of the first and second openings.

12. The X-ray shielding apparatus of claim 11, wherein an axial position of the tube member relative to one or both of the first and second shielding members is adjustable.

13. An X-ray device comprising:

an X-ray source;

an X-ray lens for redirecting X-rays emitted from the X-ray source;

an X-ray shielding component for selectively transmitting X-rays towards or through the X-ray lens, the X-ray shielding component including a stationary member having an aperture and one or more shielding members movable in relation to the stationary member and made from an X-ray shielding material, the one or more shielding members having openings defining an X-ray passage within the aperture that is smaller than the aperture, wherein the movement of the one or more shielding members is restricted such that the one or more shielding members in each position relative to the stationary member cover the aperture at least in an area outside the X-ray passage, and the X-ray shielding component further comprising a tube member constituted by an X-ray lens or configured to receive an X-ray lens, wherein one of the one or more shielding members is mounted on the tube member such that the tube member extends through the opening of this shielding member and through the aperture of the stationary member.

14. The X-ray device of claim 13, wherein the X-ray lens comprises one or more bundles of capillaries.

15. The X-ray device of claim 13, wherein the X-ray device further comprises a positioning component for the X-ray lens, the positioning component being disposed downstream of the shielding component and being made from a material that is substantially transparent to X-rays.

* * * * *